United States Patent [19]

Granneman et al.

[11] Patent Number: 5,067,063

[45] Date of Patent: Nov. 19, 1991

[54] HANDBAG LIT WITH ELECTROLUMINESCENCE

[76] Inventors: Marilyn J. Granneman; Gary N. Granneman, both of 7206 Crest La., Indianapolis, Ind. 46256

[21] Appl. No.: 609,809

[22] Filed: Nov. 6, 1990

[51] Int. Cl.[5] ..... A45C 15/6

[52] U.S. Cl. ..... 362/156; 362/84; 362/802

[58] Field of Search ..... 362/154–156, 362/205, 394, 84, 802, 34; 200/61.85

[56] References Cited

U.S. PATENT DOCUMENTS

| | | | |
|---|---|---|---|
| 1,116,276 | 11/1914 | Hoffman et al. | 200/61.85 |
| 2,218,396 | 10/1940 | Hallbauer | 362/156 |
| 2,334,480 | 11/1943 | Cross | 362/156 |
| 4,144,557 | 3/1979 | Kerr, III et al. | 362/84 |
| 4,954,934 | 9/1990 | Kidder et al. | 362/156 |
| 4,972,304 | 11/1990 | Ylla | 362/156 |

*Primary Examiner*—Ira S. Lazarus
*Assistant Examiner*—Leonard Heyman
*Attorney, Agent, or Firm*—Harness, Dickey & Pierce

[57] ABSTRACT

A handbag, valise, make up kit, or briefcase which is illuminated using an electroluminescent lamp 22. If the lamp operates on alternating current, the lamp 22 is powered by an inverter 26 which converts the direct current from the battery 28.

10 Claims, 3 Drawing Sheets

HANDBAG LIT WITH ELECTROLUMINESCENCE

BACKGROUND

1. Field of Invention

This invention involves a handbag, valise, make up kit, or briefcase with all or part of its interior, and/or exterior illuminated with one or more electroluminescent lamps.

2. Description of Prior Art

People have often had difficulty finding items in their handbags in the dark. This remains difficult even in the low-ambient lighting typical of parking lots and porches.

Prior devices for illuminating the interior of handbags, briefcases, valises, make up kits, or suitcases have utilized individual light bulbs which illuminate only small portions of the handbag immediately adjacent to the light source. These illuminating devices are typically mounted at the top of the handbag compartment and create shadows on the interior of the handbag, creating difficulty in seeing items resting on the bottom of the handbag.

Other prior art devices utilize a variety of light bulbs mounted in the various separate interior compartments within the interior of handbags. This causes manufacturing problems resulting from the need to have wiring in each compartment.

Other designs have utilized one or more bulbs mounted behind a diffusing plastic sheet. This causes the need for space to accommodate the light bulbs and sockets. Space to dissipate heat would also be required. The assembly is typically on the bottom of the handbag creating shadows where items lie on the bottom of the handbag.

All designs require the use of incandescent or fluorescent bulbs with the accompanying high current drain. This causes the need to frequently replace batteries. Most of these designs utilize incandescent bulbs which create undesirable heat which could actually damage items carried in the handbag.

OBJECTS AND ADVANTAGES

Electroluminescent lamps are thin laminated light emitting capacitors (usually 0.009" to 0.045" thick) which emit light without creating noticeable heat or substantial current drain. They are typically flexible enough to conform to the structural material used in a handbag. The lamps, however, may be the rigid ceramic or metal type. Although electroluminescent lamps have been used to backlight liquid crystal displays and graphics in automobiles, boats, and aircraft they have not been used to light handbags, briefcases, valises, or make up kits.

One of the objects of this invention is to provide an area of even light on a wall, interior or exterior panel, bottom, or top of a handbag briefcase, make up kit, or valise. This is achieved by utilizing a flat electroluminescent lamp attached to a power source. At this time, electroluminescent lamps operating from direct current are not practical. If, however, the electroluminescent lamp uses direct current the power source will be a battery, and possibly a converter which alters the direct current. If the electroluminescent lamp operates from direct current, the power source will be a battery operated inverter to change the direct current to alternating current.

The electroluminescent lamp, wiring, inverter, switch, and connectors may each be installeed at the time of manufacture of the handbag, valise, make up kit, or briefcase. The components may also be devised to be installed in the handbag, valise, make up kit, or briefcase separately or together.

The exterior of a handbag, valise, briefcase, or make up kit may also be lit for decorative or functional purposes with a lamp mounted on the exterior of an item with Velcro, snaps, zipper, clear pocket, or other means. The lamp may also be inserted at the time the handbag, valise, briefcase, or make up kit is manufactured in the same fashion as the interior lamp. The lamp used may also be a two sided lamp to simultaneously light the interior and exterior of the handbag, or to light two interior sections of the handbag, briefcase, valise, or make up kit. The light on the exterior of the handbag could be used to light objects such as key holes without the need to open the handbag. This lamp could also backlight a logo or design.

The preferred assembly would involve the installation of the inverter, switch, battery case, and connectors in the valise, briefcase, handbag, or make up kit. The lamp would then be purchased separately or with the handbag, but removable. This would allow the lamp to be moved from one handbag to another. The lamp would be inserted in a clear pocket or fastened with Velcro, clips, or other means. A connector would be furnished to allow the lamp to be quickly connected to or disconnected from each handbag. This would allow the user to light multiple handbags without the need expense involved in buying one lamp per handbag. The light may be activated or deactivated by means of either a manual or automatic switch. The automatic switch could be built in to the shoulder strap or handle, causing the lamp to be activated when the handbag is carried or lifted. The wire connecting the interior lamp to the inverter could be long enough to allow the lamp to be used outside of the handbag. The connector between the inverter and the lamp shall use three four or more pins to allow the creation of an open circuit when the lamp is unpluged. This will prevent the inverter from overheating in a no load condition.

REFERENCE NUMERALS IN DRAWINGS

20 connector
22 electroluminescent lamp
24 leads carrying current to the switch
26 inverter
28 battery
30 automatic switch
34 manual switch
36 shoulder strap
38 handbag
40 leads from battery to inverter
42 inner lining
44 Velcro
46 outer wall
48 exterior window
50 rod
54 spring

DETAILED DESCRIPTION OF THE PREFERRED EMBODIMENTS

Figure 1:
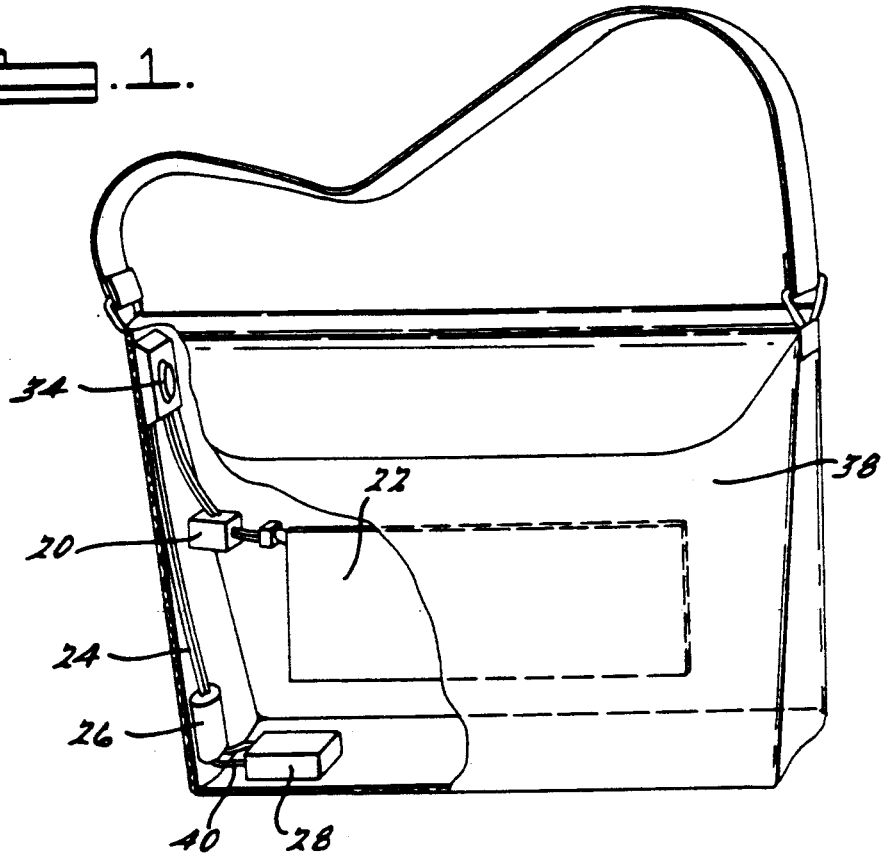
FIG. 1. represents a view of a handbag with its interior lit with electroluminescence.

FIG. 1 is a drawing representing a handbag 38 containing an electroluminescent lamp 22 which is mounted on the interior lining of the handbag 38 using a fastening system such as Velcro or snaps. The electroluminescent lamp 22 could also slide into a pocket having a clear window allowing light emission into the handbag 38. The lamp 22 could be permanently affixed between the lining and the vinyl, leather, or fabric exterior wall of the handbag 38 during manufacture of the handbag 38. The inverter 26 is sewn inside the lining with protruding leads 40 connected through the lining to a battery 28 from which it draws direct current. The inverter 26 changes the direct current supplied by the battery 28 into alternating current required by the lamp 22. The current runs through a switch 34 which is activated by the user of the handbag 38. Current is carried to the switch 34 through wires 24, and to the lamp from the switch 34 to the connector 20. Additional leads 24 carry the alternating current from the inverter 26 to a switch 34 mounted toward the top of the handbag 38. The current flows through the switch 34 and connector 20 to the electroluminescent lamp 22. With a removable lamp 22, the connector protrudes from the handbag 38 lining to allow the user of the handbag 38 to disconnect and connect the lamp 22 at will. This allows the user to transfer the lamp 22 to a variety of handbags also equipped with an inverter.

Figure 2:
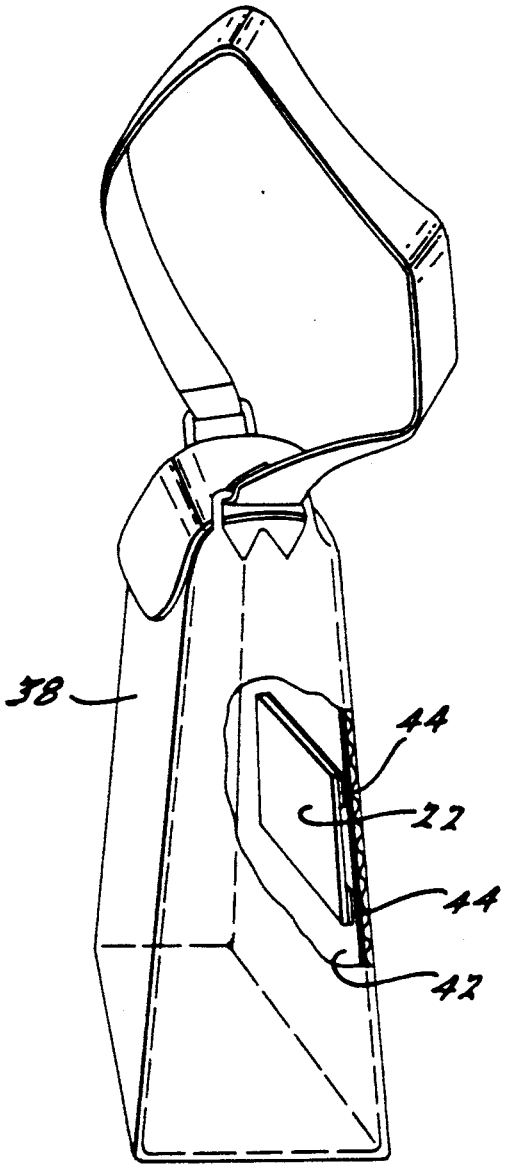
FIG. 2. represents a cross section of the outer wall of a handbag containing a built in lamp.

In FIG. 2 a cross section of the side of the handbag 38 demonstrates the lamp 22 mounted on the interior lining 42 with Velcro 44.

Figure 3:
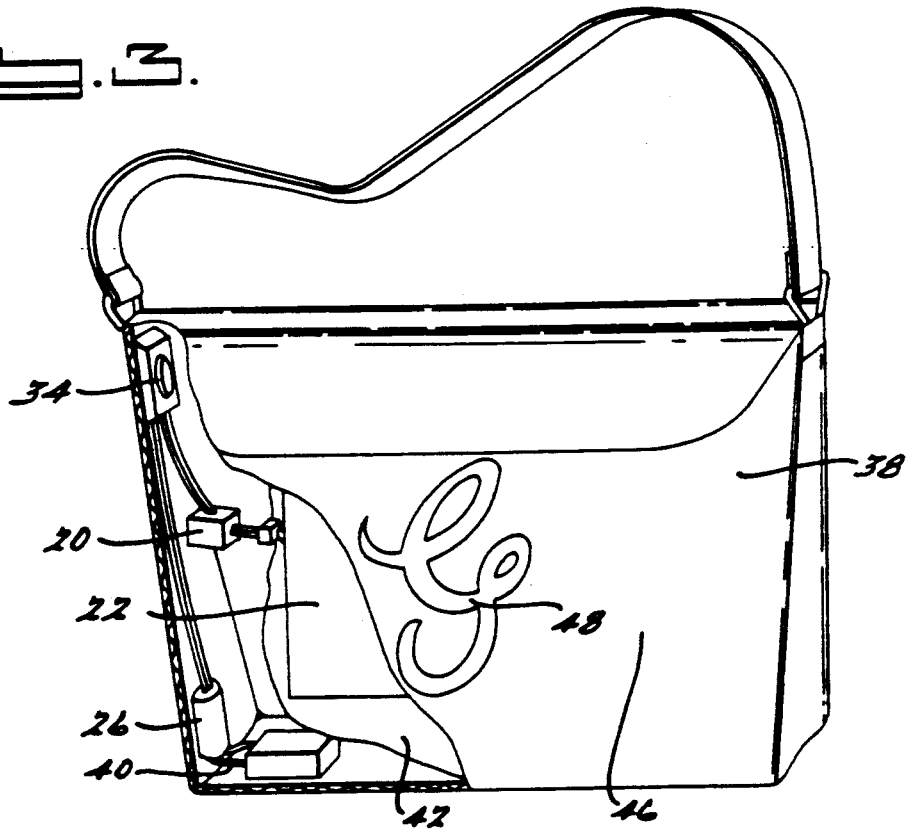
FIG. 3. represents a handbag having an exterior lamp.

FIG. 3 is a drawing representing a handbag 38 containing an electroluminescent lamp 22 which is mounted between the interior lining 42 of the handbag 38 and the outside wall 46 of the handbag 38. The electroluminescent lamp 22 emits light outside the handbag 38 through a clear window 48 sewn into the outer wall of the handbag. If a double sided lamp 22 is used, the lamp will also emit light into the handbag through a clear window in the lining 42. The inventor 26 is sewn inside the lining 42 with protruding leads 40 connected through the lining 42 to a battery 28 from which it draws direct current. The inverter 26 changes the direct current supplied by the battery 28 into alternating current required by the lamp 22. The current runs through a switch 34 which is activated by the user of the handbag 38. Current is carried to the switch 34 through wires 24, and to the lamp from the switch 34 to the connector 20. The current flows through the switch 34 and connector 20 to the electroluminescent lamp 22.

Figure 4:
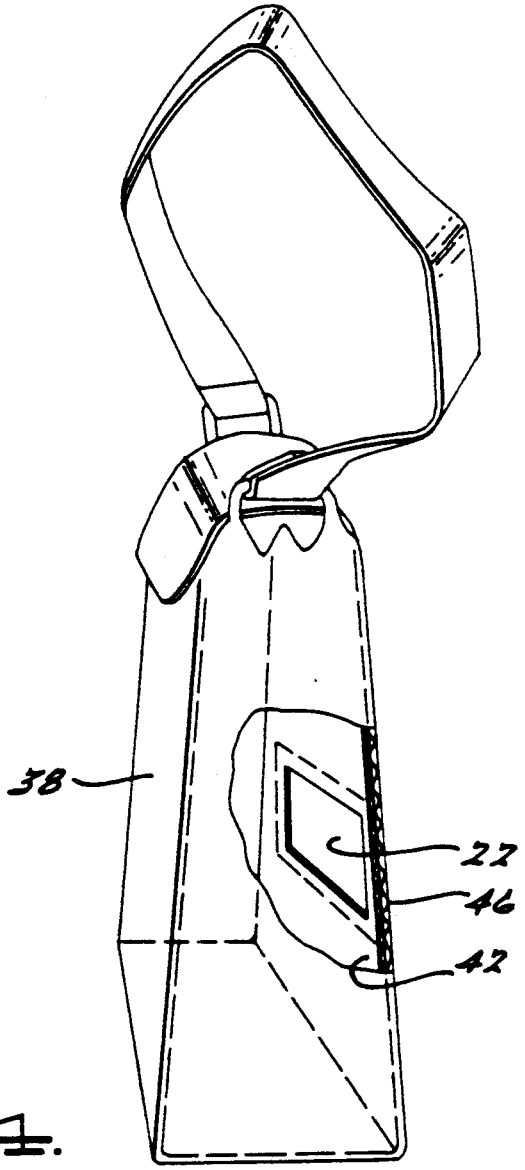
FIG. 4. represents another handbag embodiment having provisions for illuminating either the interior or the exterior of the handbag, or both.

The cross section in FIG. 4 represents an the electroluminescent lamp 22 between the interior lining 42 and the exterior wall 46 of the handbag. From this location a single sided lamp 22 can be positioned to light the interior of the handbag through interior window 50 or the exterior through exterior window 48. A two sided lamp will emit light through both the interior window 50 and the exterior window 48.

FIG. 4. also represents the option of a permanent installation of an electroluminescent lamp 22 between the inner lining 42 and the outer wall 46 of the handbag 38.

Figure 5:
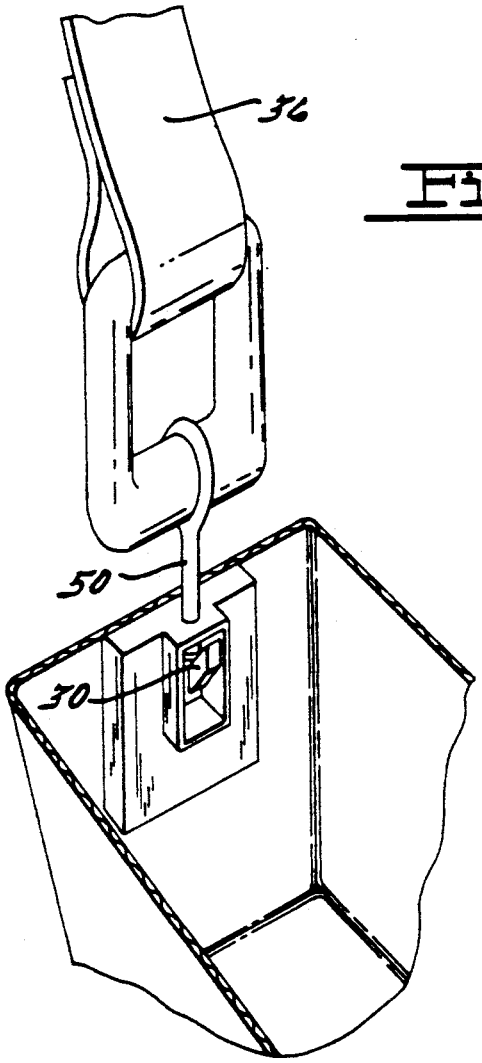
FIG. 5. represents the on position of the automatic switch which is activated by the shoulder strap or handle.

FIG. 5. represents the on position for an automatic switch 30 which can be used in conjunction with the manual switch or alone. The automatic switch 30 is activated by the lifting of the shoulder strap 36 or handle. The automatic switch will allow current to flow to the lamp when in the up position. The contacts of the switch close by way of the rod 50 attached to the shoulder strap 36 when the handbag is lifted by the shoulder strap.

Figure 6:
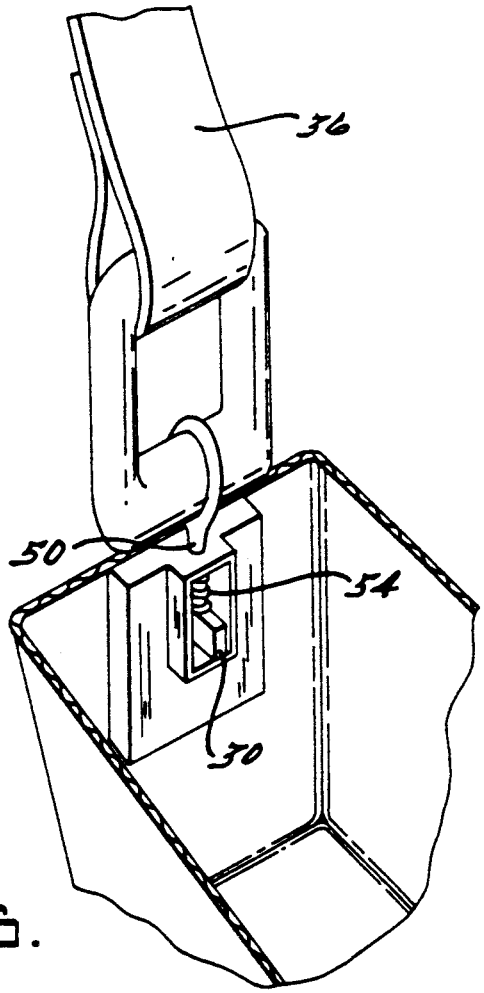
FIG. 6. represents the off position of the automatic switch which is activated by the shoulder strap.

FIG. 6. demonstrates the off position of the automatic switch 30. When the shoulder strap 36 is released the spring 54 pushes the rod 50 down putting the switch 30 in the off position and stopping current flow to the lamp.

We claim:

1. In a carrying case having at least a pair of sidewalls defining an interior compartment and closure means for selectively opening and closing the case in order to respectively gain and block access to the interior compartment, an illumination system comprising:

a power source circuit permanently installed in the interior compartment, said power source circuit including a battery holder adapted to receive a replaceable direct current battery electrically connected to said power source circuit, inverter means electrically connected to said battery holder for converting direct current from said battery to alternating current, a first releasable electrical connector means, and switch means selectively actuable between on and off positions for respectively electrically connecting and disconnecting said battery holder and said inverter means to said first releasable electrical connector means;

a thin, flexible electroluminescent lamp having a second releasable electrical connector means for selective electrical connection with, and disconnection from, said first releasable electrical connector, said lamp and said second releasable electrical connector means being selectively insertable into, and removable from, the interior compartment; and a thin transparent sheath-like pocket having an opening therein and being disposed on a first of the sidewalls of the carrying case, said lamp being selectively insertable through said opening into said pocket for illuminating the interior compartment when said first and second electrical connector means are electrically connected with one another and said switch means is actuated to said on position, and said lamp and said second electrical connector means being selectively removable from said pocket and said interior compartment for interchangeable installation and use in a second of said carrying cases having a second of said power source circuits permanently installed therein.

2. The invention of claim 1, wherein said first sidewall includes a transparent portion thereof for allowing light to pass between the interior compartment and the exterior of said carrying case, said pocket being of a thin transparent sheath-like configuration having a pair of transparent panels between which said lamp is selectively inserted and removed, said panels being aligned with said transparent portion of said first sidewall in order to selectively emit light from said lamp through said transparent portion of said first sidewall to the exterior of said carrying case.

3. The invention of claim 2, wherein said lamp is of a one-sided electroluminescent construction for emitting light to only one light-emitting side thereof, said lamp being selectively insertable into said pocket with said light-emitting side face in either an inwardly-facing orientation for illuminating the interior compartment or an outwardly-facing orientation for emitting illumination through said transparent portion of said first sidewall to the exterior of said carrying case.

4. The invention of claim 3, wherein said transparent portion of the sidewall is of a decorative shape.

5. The invention of claim 2, wherein said lamp is of a two-sided electroluminescent construction for emitting light to two sides thereof, said lamp being selectively insertable into said pocket for simultaneously illuminating the interior compartment and for emitting illumination through said transparent portion of said first sidewall to the exterior of said carrying case.

6. The invention of claim 5, wherein said transparent portion of the sidewall is of a decorative shape.

7. The invention of claim 2, wherein said carrying case includes a carrying strap interconnected therewith, said switch means including actuation means for actuating said switch means to said on position in response to a predetermined force applied to said carrying strap, said switch means being deactuated to said off position in the absence of said predetermined force on said strap.

8. The invention of claim 3, wherein said carrying case includes a carrying strap interconnected therewith, said switch means including actuation means for actuating said switch means to said on position in response to a predetermined force applied to said carrying strap, said switch means being deactuated to said off position in the absence of said predetermined force on said strap.

9. The invention of claim 5, wherein said carrying case includes a carrying strap interconnected therewith, said switch means including actuation means for actuating said switch means to said on position in response to a predetermined force applied to said carrying strap, said switch means being deactuated to said off position in the absence of said predetermined force on said strap.

10. The invention of claim 7, further including override means selectively actuable to electrically disconnect said lamp from said power source circuit regardless of the position of said switch means.

* * * * *

UNITED STATES PATENT AND TRADEMARK OFFICE

CERTIFICATE OF CORRECTION

PATENT NO. : 5,067,063

DATED : November 19, 1991

INVENTOR(S) : Granneman, et al

It is certified that error appears in the above-identified patent and that said Letters Patent is hereby corrected as shown below:

Column 3, line 50, "inventor" should be --inverter--.

Signed and Sealed this

Thirteenth Day of April, 1993

*Attest:*

STEPHEN G. KUNIN

*Attesting Officer*

*Acting Commissioner of Patents and Trademarks*